US006338370B1

(12) United States Patent
Edwards et al.

(10) Patent No.: US 6,338,370 B1
(45) Date of Patent: Jan. 15, 2002

(54) FILL VALVE ASSEMBLY FOR FILLER DEVICE AND ASSOCIATED METHOD

(75) Inventors: Simon P. Edwards, Irvine, CA (US); Michael R. Resterhouse, Muskegon; Randall L. Johnson, Grand Haven, both of MI (US)

(73) Assignees: Fogg Filler Company, Holland, MI (US); Scholle Corporation, Irvine, CA (US)

( * ) Notice: Subject to any disclaimer, the term of this patent is extended or adjusted under 35 U.S.C. 154(b) by 0 days.

(21) Appl. No.: 09/584,296

(22) Filed: May 31, 2000

(51) Int. Cl.[7] ..... B65B 1/04

(52) U.S. Cl. ..... 141/90; 141/89; 141/91

(58) Field of Search ..... 141/89, 90, 91, 141/85; 137/238, 239, 240; 251/63, 63.5; 222/559; 92/13.1, 13.4, 13.6, 62

(56) References Cited

U.S. PATENT DOCUMENTS

| | | | | |
|---|---|---|---|---|
| 2,478,790 A | * | 8/1949 | Stephens | |
| 2,722,402 A | * | 11/1955 | Crookston | |
| 3,430,539 A | | 3/1969 | Roberts | |
| 3,774,658 A | | 11/1973 | Abramoaka, Jr. | |
| 3,926,229 A | * | 12/1975 | Scholle | 141/90 |
| 4,136,851 A | * | 1/1979 | Hansen et al. | 251/63.5 |
| 4,219,054 A | | 8/1980 | Carter et al. | |
| 4,437,498 A | | 3/1984 | Pankratz et al. | |
| 4,615,354 A | * | 10/1986 | Bianchi | 251/63.5 |
| 4,848,381 A | | 7/1989 | Livingston et al. | |
| 5,402,833 A | | 4/1995 | Clüserath | |
| 5,450,882 A | | 9/1995 | Cragun | |
| 5,531,253 A | | 7/1996 | Nishiyama et al. | |
| 5,533,552 A | | 7/1996 | Ahiers | |
| 5,690,151 A | | 11/1997 | Ruttier et al. | |
| 5,740,844 A | | 4/1998 | Miller | |
| 5,845,683 A | | 12/1998 | Sundby et al. | |
| 5,878,992 A | * | 3/1999 | Edwards et al. | 251/63.5 |

FOREIGN PATENT DOCUMENTS

| | | | | |
|---|---|---|---|---|
| EP | 0 554 951 A1 | | 2/1993 | |
| EP | 0 568 121 A1 | | 2/1993 | |
| JP | 53136177 A | * | 11/1978 | 92/62 |
| JP | 5383762 A | * | 5/1982 | 251/63 |

* cited by examiner

*Primary Examiner*—Timothy L. Maust
*Assistant Examiner*—Khoa D. Huynh
(74) *Attorney, Agent, or Firm*—Factor & Partners, LLC

(57) ABSTRACT

A fill valve assembly for use in association with a filler device. The fill valve assembly generally includes: an outer housing; a product dispensing member; a displaceable piston; and mechanisms for controllably displacing the piston to a clean-in-place position. The product dispensing member is associated with the outer housing and includes a channel having a sealing member retained therein. The displaceable piston is positioned within at least a portion of the outer housing and the product dispensing member. When the piston is in the clean-in-place position, the seal member retained within the channel of the product dispensing member is exposed which facilitates cleaning thereabout.

20 Claims, 5 Drawing Sheets

FILL VALVE ASSEMBLY FOR FILLER DEVICE AND ASSOCIATED METHOD

BACKGROUND OF THE INVENTION

1. Field of the Invention

The present invention relates in general to a fill valve assembly, and more particularly, to a fill valve assembly, for use in association with a filler device, which is configurable into a clean-in-place mode of operation for cleaning predetermined components associated therein.

2. Background Art

Fill valve assemblies for use in association with filler devices have been known in the art for years and are the subject of numerous patents including: U.S. Pat. Nos. 5,845,683; 5,740,844; 5,690,151; 5,533,552; 5,531,253; 5,450,882; 5,402,833; 4,848,381; 4,437,498; 4,219,054; 3,774,658; 3,568,734; 3,430,639; EP Pat. No. 568121 A1; and EP Pat. No. 554951 A1. While fill valve assemblies have become commercially available for use in association with filler devices, problems associated with cleaning internal components remain largely problematic—especially when the fill valve assembly is being used for filling a food product where cleanliness standards are relatively stringent.

It is therefore an object of the present invention to provide a reliable fill valve assembly for use in association with filler devices which remedies the detriments and/or complications associated with conventional fill valve assemblies known in the art.

These and other objects of the present invention will become apparent in light of the present specification, claims, and drawings.

SUMMARY OF THE INVENTION

The present invention is directed to a fill valve assembly for use in association with a filler device comprising: (a) an outer housing; (b) a product dispensing member associated with the outer housing, wherein the product dispensing member includes a channel having a sealing member retained therein; (c) a displaceable piston positioned within at least a portion of the outer housing and the product dispensing member; and (d) means for controllably displacing the piston to a clean-in-place position, to in turn, expose the seal member retained within the channel of the product dispensing member for facilitating cleaning thereabout.

In a preferred embodiment of the invention fill valve assembly further comprises means for controllably displacing the piston to the clean-in-place position, an open position, and a closed position. In this embodiment, the clean-in-place piston displacing means may comprise a first aperture associated with a stop plunger, a second aperture and a third aperture associated with the outer housing, wherein the first and second apertures are exhausted to ambient and the third aperture is supplied with a pneumatic source.

In addition, the open piston displacing means may comprise a first aperture associated with a stop plunger, a second aperture and a third aperture associated with the outer housing, wherein the first aperture is exhausted to ambient, and the second and third apertures are supplied with a pneumatic source.

Moreover, the closed piston displacing means may comprise a first aperture associated with a stop plunger, a second aperture and a third aperture associated with the outer housing, wherein the first and second apertures are supplied with a pneumatic source and the third aperture is exhausted to ambient.

In another preferred embodiment of the invention, the piston may comprise a concave region near a lower end thereof, whereby the concave region forms an exposed volume around the seal member upon displacement of the piston to the clean-in-place position.

In yet another preferred embodiment of the invention, the clean-in-place piston displacing means may comprise the piston being displaced into a stop plunger, wherein the stop plunger is at least partially retracted away from the seal member retained within the channel of the product dispensing member.

The present invention is also directed to a fill valve assembly for use in association with a filler device comprising: (a) an outer housing, wherein the outer housing includes a channel having a sealing member retained therein; (b) a displaceable piston positioned within at least a portion of the outer housing; and (c) means for controllably displacing the piston to a clean-in-place position, to in turn, expose the seal member retained within the outer housing to facilitate cleaning thereabout.

The present invention is further directed to a fill valve assembly for use in association with a filler device comprising: (a) an outer housing; (b) a product dispensing member associated with the outer housing, wherein the product dispensing member includes a channel having a sealing member retained therein; (c) a displaceable piston positioned within at least a portion of the outer housing and the product dispensing member, wherein the piston comprises a concave region near a lower end thereof, whereby the concave region forms an exposed volume around the seal member retained within the product dispensing member upon displacement of the piston to the clean-in-place position.

In accordance with the present invention, the fill valve assembly may also comprise: (a) an outer housing, wherein the outer housing includes a channel having a sealing member retained therein; and (b) a displaceable piston positioned within at least a portion of the outer housing, wherein the piston is displaceable into a closed position, an open position, and a clean-in-place position, wherein the clean-in-place position exposes the seal member retained within the outer housing for facilitating cleaning thereabout.

The present invention further provides a method of using a fill valve assembly associated with a filler device comprising the steps of: (a) providing a fill valve assembly including: (1) an outer housing having second and third apertures; (2) a product dispensing member associated with the outer housing having a channel with a sealing member retained therein; (3) a displaceable piston positioned within at least a portion of the outer housing and the product dispensing member; and (4) a stop plunger having an aperture positioned within at least a portion of the outer housing; (b) configuring the piston into a closed position and precluding product from passing through the product dispensing chamber, (c) configuring the piston into an open position and dispensing a product through the product dispensing member; and (d) configuring the piston into a clean-in-place position and exposing the seal member retained within the channel of the product dispensing member; and (e) flushing the exposed seal member with matter to, in turn, substantially remove any undesirable contamination associated therewith.

BRIEF DESCRIPTION OF THE DRAWINGS

The invention will now be described with reference to the drawings wherein.

DETAILED DESCRIPTION OF THE INVENTION

Figure 1:
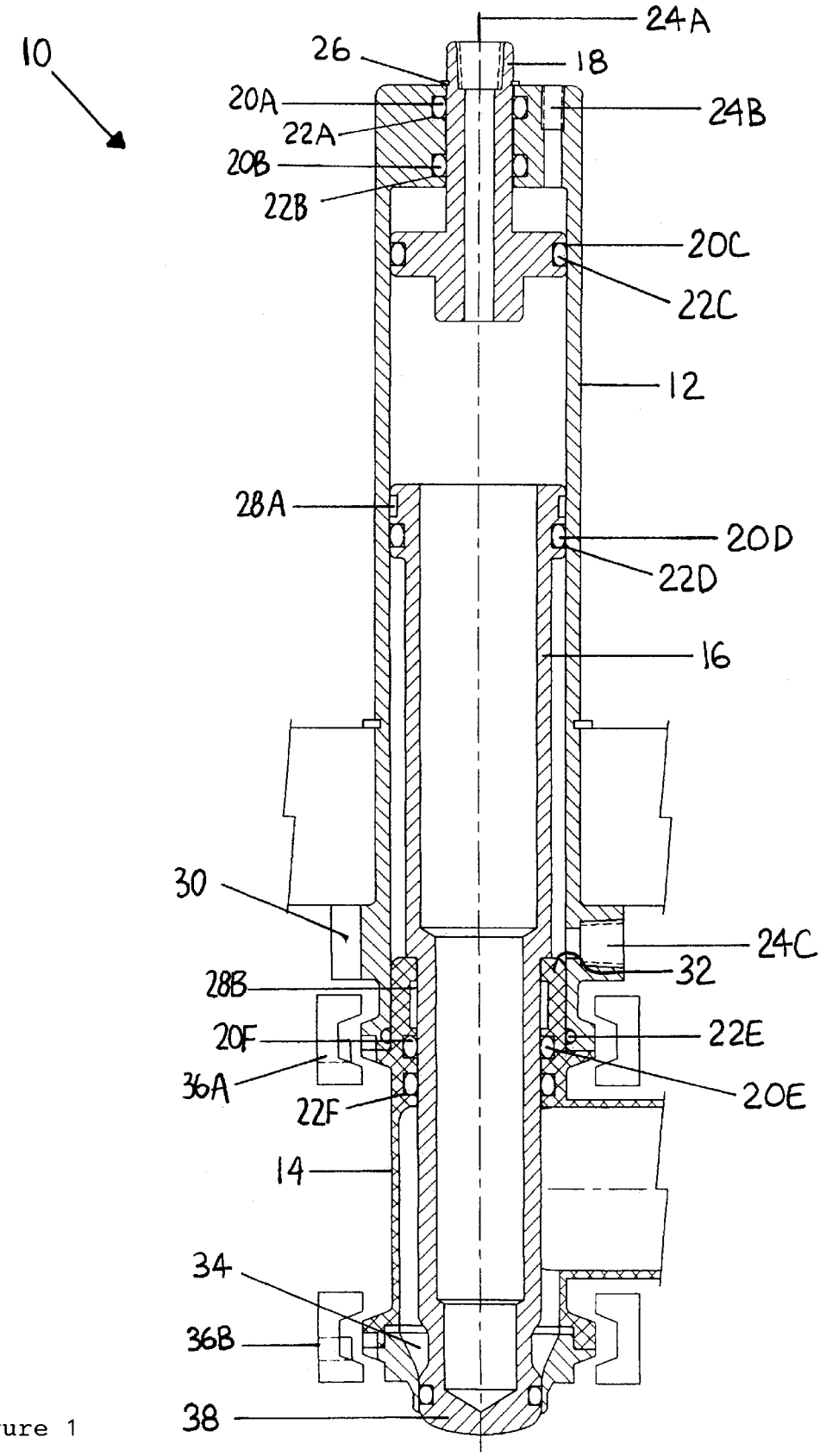
FIG. 1 of the drawings is a cross-sectional schematic representation of a fill valve assembly showing, among other things, a piston in a closed position.
Figure 2:
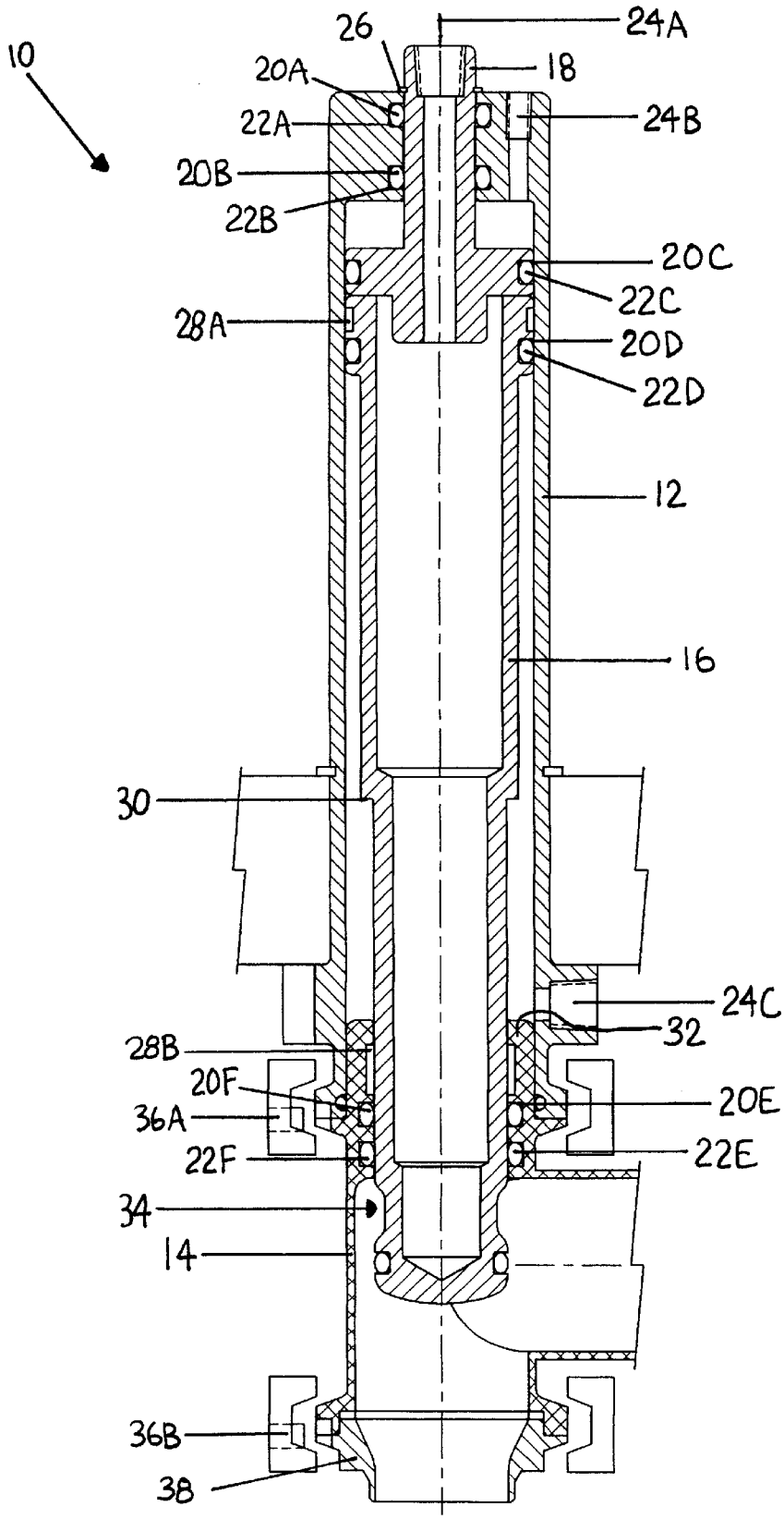
FIG. 2 of the drawings is a cross-sectional schematic representation of a fill valve assembly showing, among other things, a piston in an open, fill position.
Figure 3:
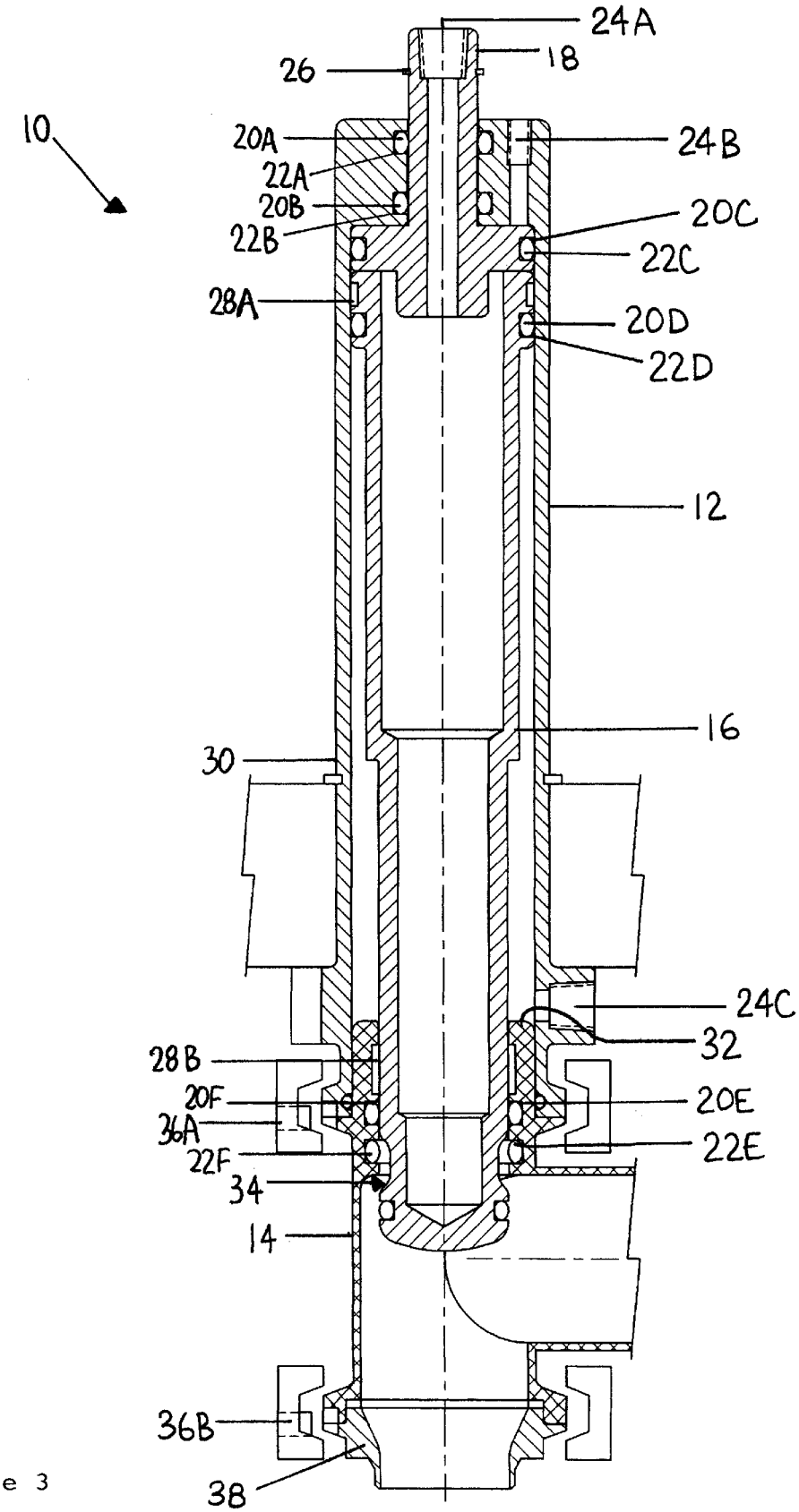
FIG. 3 of the drawings is a cross-sectional schematic representation of a fill valve assembly showing, among other things, a piston in a clean-in-place position.

While this invention is susceptible of embodiment in many different forms, there is shown in the drawings and described herein in detail several specific embodiments with the understanding that the present disclosure is to be considered as an exemplification of the principles of the invention and is not intended to limit the invention to the embodiments illustrated.

It will be understood that like or analogous elements and/or components, referred to herein, are identified throughout the drawings by like reference characters.

Referring now to the drawings and to FIG. 1 in particular, a cross-sectional schematic representation of a first embodiment of fill valve assembly 10 is shown, which generally comprises outer housing 12, product dispensing member 14, piston 16 (in a closed position), and stop plunger 18 for controllably displacing the piston to, a clean-in-place position, among other positions, which as will be discussed in greater detail below exposes seal member 20F (e.g. an o-ring) retained within the channel 22F of product dispensing member 14 for facilitating cleaning thereabout. It will be understood that the term seal member is herein defined as any member that is capable of creating an at least partially fluid seal between at least two surfaces. Preferably, such a seal member is fabricated from an elastomeric material, however, numerous other materials that would be known to those having ordinary skill in the art are likewise contemplated for use in accordance with the present invention.

It will be further understood that the FIGS. 1A–5 are merely schematic representations. As such, some of the components have been distorted from their actual scale for pictorial clarity.

Figure 4:
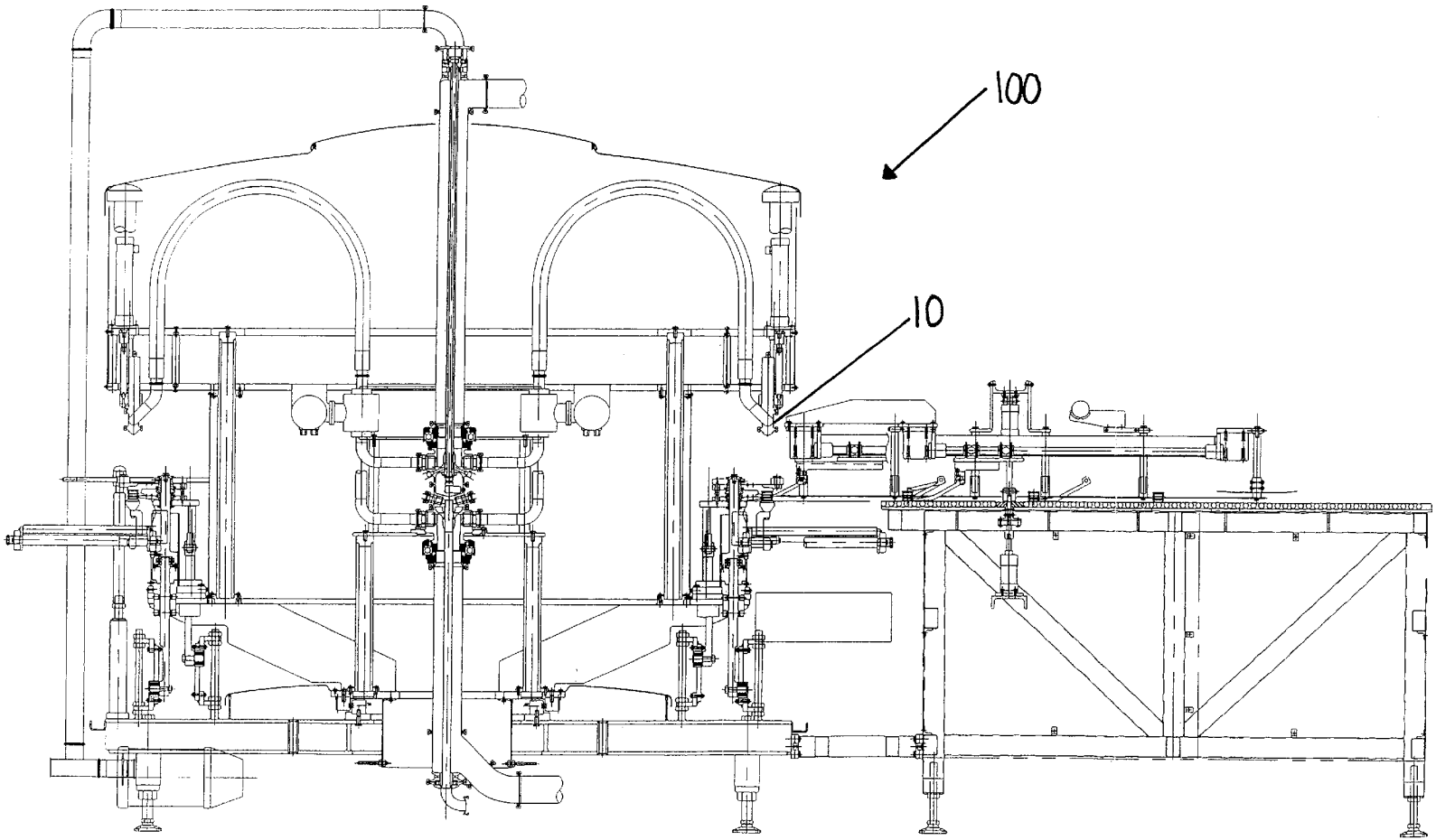
FIG. 4 of the drawings is a cross-sectional schematic representation of a fill valve assembly associated with a filler device.

As is shown in FIG. 4, fill valve assembly 10 is primarily intended for use in association with filler device 100, which is capable of filling associated containers and/or bags with any one of a number of materials in solid, liquid, and/or gaseous states. It will be understood that while fill valve assembly 10 has been shown, for illustrative purposes only, as being associated with a rotary filler device, numerous other device configurations that would be known to those having ordinary skill in the art with the present disclosure before them are likewise contemplated for use.

Referring again to FIG. 1, outer housing 12 includes seal members 20A and 20B, which are retained within channels 22A and 22B, respectively. Seal members 20A and 20B slidably seal stop plunger 18 within outer housing 12, thereby substantially precluding fluid and/or other matter from passing therebetween. Outer housing 12 also includes apertures 24B and 24C, which as will be discussed in detail below, facilitate displacement of stop plunger 18 and, in turn, piston 16.

As is shown in FIG. 1, stop plunger 18 is displaceably retained within outer housing 12 at an upper end thereof. Stop plunger 18 includes seal member 20C which is retained within channel 22C. Seal member 20C slidably seals stop plunger 18 within outer housing 12, thereby substantially precluding fluid and/or other matter from passing therebetween. Stop plunger 18 includes retaining ring 26, which controllably regulates the degree of downward displacement of stop plunger 18. As will de discussed in greater detail below, stop plunger 18 further includes aperture 24A, which can be coupled to, for example, a pneumatic source for displacing piston 16 to a closed position.

Piston 16 is displaceably retained within outer housing 12 below stop plunger 18. Piston 16 includes seal member 20D which is retained within channel 22D. Seal member 20D slidably seals piston 16 within outer housing 12, thereby substantially precluding fluid and/or other matter from passing therebetween. Piston 16 also includes upper and lower guide bushings 28A and 28B, respectively, which cooperatively facilitate proper displacement of piston 16. Piston 16 also includes shoulder 30, which controllably regulates the downward displacement of piston 16 by contacting upper surface 32 of product dispensing chamber 14.

Figure 5:
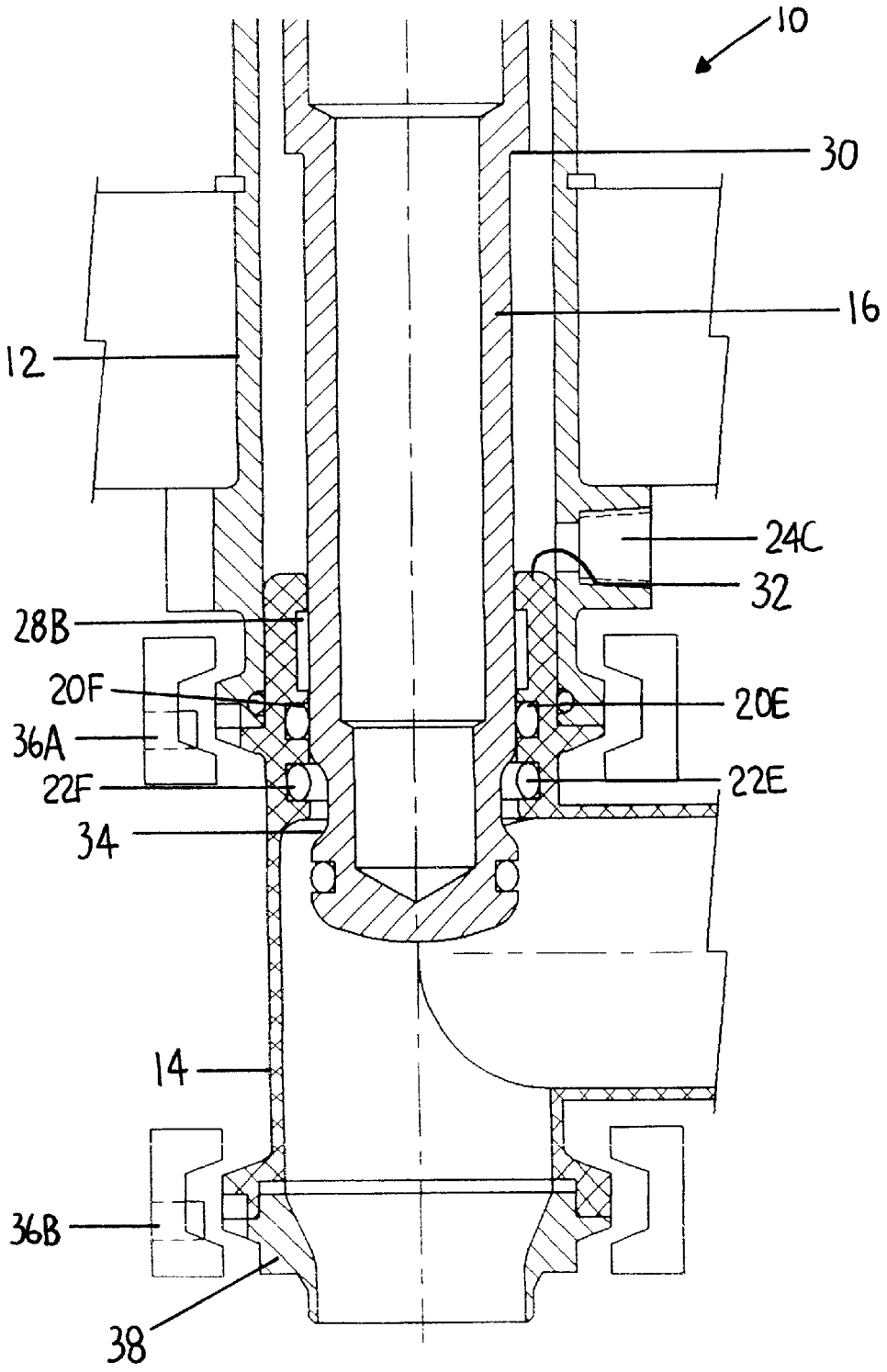
FIG. 5 of the drawings is a fragmented cross-sectional schematic representation of a fill valve assembly showing, among other things, an exposed seal member retained with a channel of a product dispensing member.

As is best shown in FIG. 5, piston 16 (in a clean-in-place position) includes a concave region 34, which exposes the seal member 20F retained within channel 22F of product dispensing member 14 for facilitating cleaning thereabout. While piston 16 has been shown, for illustrative purposes only, as including concave region 34, it is likewise contemplated that other geometric configurations are likewise contemplated for use—so long as the particular geometric configuration exposes seal member 20F retained within the product dispensing member for facilitating cleaning thereabout.

Referring back to FIG. 1, product dispensing member 14 is associated with outer housing 12, and is secure thereto by connecting clamp 36A. Product dispensing member 14 includes seal members 20E and 20F, which are retained within channels 22E and 22F, respectively. Sealing members 20E and 20F slidably seal piston 16 within product dispensing member 14, thereby substantially precluding fluid and/or other matter from passing therebetween when the piston is in either a closed position (See FIG. 1) or an open position (See FIG. 2B).

Filling tip 38 is associated with product dispensing member 14, and is secured thereto by connecting clamp 36B. Filling tip 38 serves to sealingly connect fill valve assembly 10 to an associated container and/or bag (not shown).

As is shown in FIG. 1A, in a preferred embodiment of the invention, piston 16 of fill valve assembly 10 is displaceable to a closed position by supplying apertures 24A and 24B with a pneumatic source and by venting aperture 24C to ambient. In such a closed position any product contained within product dispensing chamber 14 is precluded from entering an associated container and/or bag. It will be understood that piston 16 is also displaceable to a closed position without supplying aperture 24B with a pneumatic source.

As is shown in FIG. 2B, piston 16 of fill valve assembly 10 is displaceable to an open or fill position by supplying apertures 24B and 24C with a pneumatic source and by venting aperture 24A to ambient. In such an open position any product contained within product dispensing chamber 14 is free to flow into an associated container and/or bag.

As is shown in FIG. 3C, piston 16 of fill valve assembly 10 is displaceable to a clean-in-place position by supplying aperture 24C with a pneumatic source and by venting apertures 24A and 24B to ambient. As is best shown in FIG. 5, piston 16 exposes the seal member 20F retained within channel 22F of product dispensing member 14 for facilitating cleaning thereabout. It will be understood that seal member 20F and its surrounding area can be flushed, and, in turn, cleaned with any one of a number of cleaning fluids and/or gasses.

While outer housing 12 of fill valve assembly 10 has been disclosed herein as being associated with a separate product dispensing member component 14, it is also contemplated that outer housing 12 can be fabricated as a unitary piece which includes the structure of product dispensing member 14. In such an embodiment, seal member 20F is retained within channel 22F of outer housing 12 instead of product dispensing member 14.

The foregoing description merely explains and illustrates the invention and the invention is not limited thereto except insofar as the appended claims are so limited, as those skilled in the art who have the disclosure before them will be able to make modifications without departing from the scope of the invention.

What is claimed is:

1. A fill valve assembly for use in association with a filler device, comprising:

an outer housing;

a product dispensing member associated with the outer housing, wherein the product dispensing member includes a channel having a sealing member retained therein;

a displaceable piston positioned within at least a portion of the outer housing and the product dispensing member, wherein the piston is displaceable into a clean-in-place, an open, and a closed position; and means for controllably displacing the piston to the clean-in-place position, to in turn, expose the seal member retained within the channel of the product dispensing member for facilitating cleaning thereabout.

2. The fill valve assembly according to claim 1, further comprising means for controllably displacing the piston to the open position and the closed position.

3. The fill valve assembly according to claim 2, wherein the means for displacing the piston to the open position comprises a first aperture associated with a stop plunger, a second aperture and a third aperture associated with the outer housing, wherein the first aperture is exhausted to ambient, and the second and third apertures are supplied with a fluid from a pneumatic source.

4. The fill valve assembly according to claim 2, wherein the means for displacing the piston to the closed position comprises a first aperture associated with a stop plunger, a second aperture and a third aperture associated with the outer housing, wherein the first and second apertures are supplied with a fluid from a pneumatic source and the third aperture is exhausted to ambient.

5. The fill valve assembly according to claim 1, wherein the piston comprises a concave region near a lower end thereof, whereby the concave region forms an exposed volume around the seal member upon displacement of the piston to the clean-in-place position.

6. The fill valve assembly according to claim 1, wherein the seal member comprises an o-ring.

7. A fill valve assembly for use in association with a filler device, comprising:

an outer housing, wherein the outer housing includes a channel having a sealing member retained therein;

a displaceable piston positioned within at least a portion of the outer housing, wherein the piston is displaceable into a clean-in-place, an open, and a closed position; and means for controllably displacing the piston to the clean-in-place position, to in turn, expose the seal member retained within the outer housing for facilitating cleaning thereabout.

8. The fill valve assembly according to claim 7, further comprising means for controllably displacing the piston to the open position and the closed position.

9. The fill valve assembly according to claim 8, wherein the means for displacing the piston to the open position comprises a first aperture associated with a stop plunger, a second aperture and a third aperture associated with the outer housing, wherein the first aperture is exhausted to ambient, and the second and third apertures are supplied with a fluid from a pneumatic source.

10. The fill valve assembly according to claim 8, wherein the means for displacing the piston to the closed position comprises a first aperture associated with a stop plunger, a second aperture and a third aperture associated with the outer housing, wherein the first and second apertures are supplied with a fluid from a pneumatic source and the third aperture is exhausted to ambient.

11. The fill valve assembly according to claim 7, wherein the piston comprises a concave region near a lower end thereof, whereby the concave region forms an exposed volume around the seal member upon displacement of the piston to the clean-in-place position.

12. The fill valve assembly according to claim 7, wherein the seal member comprises an o-ring.

13. A method of using a fill valve assembly associated with a filler device, comprising steps for:

providing a fill valve assembly including:

an outer housing having second and third apertures;

a product dispensing member associated with the outer housing having a channel with a sealing member retained therein;

a displaceable piston positioned within at least a portion of the outer housing and the product dispensing member; and a stop plunger having a first aperture positioned within at least a portion of the outer housing;

positioning the piston into a closed position and precluding product from passing through the product dispensing chamber;

positioning the piston into an open position and dispensing a product through the product dispensing member;

positioning the piston into a clean-in-place position and exposing the seal member retained within the chapel of the product dispensing member; and flushing the exposed seal member with matter to, in turn, substantially remove any undesirable contamination associated therewith.

14. The method according to claim 13, wherein the step for positioning the piston into an open position comprises the steps of exhausting the first aperture to ambient, and supplying the second and third apertures with a fluid from a pneumatic source.

15. The method according to claim 13, wherein the step for positioning the piston into a closed position comprises the steps of supplying the first and second apertures with a fluid from a pneumatic source, and exhausting the third aperture to ambient.

16. The method according to claim 13, wherein the step for positioning the piston into a clean-in-place position comprises the steps of supplying the third aperture with a fluid from a pneumatic source, and exhausting the first and second apertures to ambient.

17. A fill valve assembly for use in association with a filler device, comprising:

an outer housing, wherein the outer housing includes a second aperture and a third aperture;

a stop plunger at least partially positioned within the outer housing, wherein the stop plunger includes a first aperture;

a product dispensing member associated with the outer housing, wherein the product dispensing member includes a channel having a sealing member retained therein; and a displaceable piston positioned within at least a portion of the outer housing and the product dispensing member, wherein the piston is displaceable into a clean-in-place, an open, and a closed position, and wherein the piston is displaceable into the clean-in-place position when the first and second apertures are exhausted to ambient and the third aperture is supplied with a fluid from a pneumatic source, and further wherein the piston comprises a concave region near a lower end thereof, whereby the concave region forms an exposed volume around the seal member upon displacement of the piston to the clean-in-place position.

18. A fill valve assembly for use in association with a filler device, comprising:

an outer housing, wherein the outer housing includes a second aperture and a third aperture;

a stop plunger at least partially positioned within the outer housing, wherein the stop plunger includes a first aperture;

a product dispensing member associated with the outer housing, wherein the product dispensing member includes a channel having a sealing member retained therein; and a displaceable piston positioned within at least a portion of the outer housing and the product dispensing member, wherein the piston is displaceable into a clean-in-place, an open, and a closed position, and wherein the piston is displaceable into the clean-in-place position when the stop plunger, and, in turn, the piston is at least partially retracted away from the seal member retained within the channel of the product dispensing member, and further wherein the piston comprises a concave region near a lower end thereof, whereby the concave region forms an exposed volume around the seal member upon displacement of the piston to the clean-in-place position.

19. A fill valve assembly for use in association with a filler device, comprising:

an outer housing, wherein the outer housing includes a channel having a sealing member retained therein, and further wherein the outer housing includes a second aperture and a third aperture;

a stop plunger at least partially positioned within the outer housing, wherein the stop plunger includes a first aperture; and a displaceable piston positioned within at least a portion of the outer housing, wherein the piston is displaceable into a clean-in-place, an open, and a closed position, and wherein the piston is displaceable into the clean-in-place position when the first and second apertures are exhausted to ambient and the third aperture is supplied with a fluid from a pneumatic source, and further wherein the piston comprises a concave region near a lower end thereof, whereby the concave region forms an exposed volume around the seal member upon displacement of the piston to the clean-in-place position.

20. A fill valve assembly for use in association with a filler device, comprising:

an outer housing, wherein the outer housing includes a channel having a sealing member retained therein, and further wherein the outer housing includes a second aperture and a third aperture;

a stop plunger at least partially positioned within the outer housing, wherein the stop plunger includes a first aperture; and a displaceable piston positioned within at least a portion of the outer housing, wherein the piston is displaceable into a clean-in-place, an open, and a closed position, and wherein the piston is displaceable into the clean-in-place position when the stop plunger, and, in tun, the piston is at least partially retracted away from the seal member retained within the channel of the product dispensing member, and further wherein the piston comprises a concave region near a lower end thereof, whereby the concave region forms an exposed volume around the seal member upon displacement of the piston to the clean-in-place position.

* * * * *